US006474605B1

(12) United States Patent
Wydotis et al.

(10) Patent No.: US 6,474,605 B1
(45) Date of Patent: Nov. 5, 2002

(54) POINT DETECTOR SLEEVE FOR RAILROAD SWITCH MACHINE AND ASSOCIATED METHOD

(75) Inventors: Leonard M. Wydotis, Columbia, SC (US); Fred E. Woodlief, Lexington, SC (US); Kevin M. McQuistian, Export, PA (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 0 days.

(21) Appl. No.: 09/934,754

(22) Filed: Aug. 22, 2001

(51) Int. Cl.[7] ..... E01B 7/24
(52) U.S. Cl. ..... 246/476; 246/220
(58) Field of Search ..... 246/476, 452, 246/404, 415 R, 407, 450; 285/55, 52, 49; 29/557, 558

(56) References Cited

U.S. PATENT DOCUMENTS

| | | | | |
|---|---|---|---|---|
| 1,467,327 A | * | 9/1923 | Kelloway | 246/452 |
| 1,485,966 A | | 3/1924 | Dixon | |
| 3,624,820 A | | 11/1971 | Brown | |
| 5,348,257 A | * | 9/1994 | Ocampo | 246/220 |
| 5,471,719 A | * | 12/1995 | Sawyers | 102/508 |
| 5,527,005 A | * | 6/1996 | Wydotis | 246/404 |
| 5,774,971 A | * | 7/1998 | Manetta et al. | 29/458 |

FOREIGN PATENT DOCUMENTS

| | | | |
|---|---|---|---|
| JP | 07133696 A | * | 7/1995 |
| JP | 7133969 A | * | 5/1999 |

* cited by examiner

*Primary Examiner*—S. Joseph Morano
*Assistant Examiner*—Frantz F. Jules
(74) *Attorney, Agent, or Firm*—Brij K. Agarwal; Eckert Seamans Cherin & Mellott, LLC

(57) ABSTRACT

An improved point detector sleeve includes a tube portion and an adjustment portion that are integrally formed with one another as a monolithic member, whereby the point detector sleeve is substantially free of joints between the tube portion and the adjustment portion. The tube portion includes a beveled surface formed thereon, and the adjustment portion includes an internally threaded region formed thereon. In accordance with one method of manufacturing the improved point detector sleeve, a first end of a cylindrical pipe formed with a cylindrical cavity is cut with a rotary cutting tool to form a substantially cylindrical inner surface. The rotary cutting tool advantageously closely follows the cavity to form the cylindrical inner surface without the rotary cutting tool radially "walking" away from a central longitudinal axis of the pipe. In another embodiment, the pipe receives therein an insert having an externally threaded region and an internally threaded surface.

22 Claims, 5 Drawing Sheets

POINT DETECTOR SLEEVE FOR RAILROAD SWITCH MACHINE AND ASSOCIATED METHOD

BACKGROUND OF THE INVENTION

1. Field of the Invention

The present invention relates generally to railroad switch machinery and, particularly, to a point detector sleeve for a railroad switch machine.

2. Description of the Related Art

Numerous types of known railroad switch machines are used for switching trains between a first set of railroad tracks and a second set of railroad tracks. Switch machines typically are operatively connected with a pair of movable tracks that are connected with one another and are selectably movable and engageable with a first substantially stationary stock rail and a second substantially stationary stock rail. As is generally understood in the relevant art, when one of the movable tracks is engaged with the first stock rail, a train traveling over the tracks controlled by the switch machine remains on the first set of railroad tracks. When the other movable track is engaged with the second stock rail, a train traveling over the tracks controlled by the switch machine is switched onto the second set of railroad tracks.

Most, if not all, railroad switch machines in use in the United States include a power apparatus, a locking apparatus, and a detection apparatus, all of which extend between the switch machine and the movable tracks. The power apparatus provides the motile force needed to move the movable tracks between a first position engaged with the first stock rail and a second position engaged with the second stock rail. The locking apparatus retains the movable tracks in either the first position or the second position. The detection apparatus detects the position of the movable tracks with respect to the first and second stock rails to determine whether or not the movable tracks are correctly positioned and are in a condition whereby a train can traverse the tracks controlled by the switch machine.

The detection apparatus typically includes a point detector bar that extends between the movable tracks and the switch machine. The point detector bar includes a beveled surface that provides a transition between a connector bar portion that is connected with the movable tracks and a shank portion that is opposite the movable tracks, the connector bar having a greater cross-sectional diameter than the shank. The shank includes an externally threaded region upon which a point detector sleeve is threadably mounted. The point detector sleeve has its own beveled surface formed thereon and that is spaced from the beveled surface of the point detector bar.

The detection apparatus further includes a pair of cam followers that are each movably operated by separate linkage systems, and the cam followers are each operatively connected with an indication system. During operation of the detection apparatus, one of the linkages seeks to translate its associated the cam follower from a first position at a first radial distance from the shank toward a second position that is at a second closer radial distance from the shank. Such movement of the cam follower occurs between the two aforementioned beveled surfaces, and at the second radial distance the cam follower is disposed closely adjacent the shank but not in contact therewith. If, however, the movable track associated with the cam follower does not become engaged or is spaced too far away from its corresponding stock rail, the point detector bar does not translate to its anticipated position, with the result that the aforementioned translation of the cam follower will cause the cam follower to engage one of the connector bar and the point detector sleeve. Such a condition causes the indication system to provides an indication that the tracks are unsafe and that trains should not pass over the switch.

As is understood in the relevant art, the beveled surfaces of the detection apparatus are adjusted to correspond with the engagement of the movable tracks with the first and second stock rails. More specifically, when one of the movable tracks is engaged with one of the stock rails, structures connecting the point detector bar with the movable tracks are adjusted until the beveled surface on the point detector bar is only slightly spaced from the associated cam follower. Similarly, the point detector sleeve is rotatably and threadably adjusted on the externally threaded region of the point detector bar such that when the other of the movable rails is engaged with the other stock rail the beveled surface on the point detector sleeve is only slightly spaced from the other cam follower. Such threaded adjustability of the detection apparatus is desirable for a number of reasons related to wear of the components of the switch machine and the tracks, thermal expansion and contraction of components, as well as other factors.

A previously known point detector sleeve 2 is indicated generally in FIG. 1. The previously known point detector sleeve 2 can be generally stated as including a slide tube 4 and a nut 6 that is fixedly attached to the slide tube 4 with a weld 8. As can be seen in FIG. 1, the slide tube 4 is a generally hollow cylindrical member having an inner slide surface 10 that is smooth and free of threads and having a substantially frusto-conic beveled surface 13 opposite the nut 6. The nut 6 includes a threaded nut surface 12 that is threadably cooperable with the externally threaded region of the point detector bar. Such previously known point detector sleeves 2 have not, however, been without limitation.

It is understood that such previously known point detector sleeves 2 have been designed to translate longitudinally in conjunction with the point detector bar according to the movements of the movable tracks. It is also known that railroad tracks and switches provide a highly punishing environment in which components are subjected to substantial impact and vibration loading. In this regard, it has been found that the nut 6 sometimes separates from the slide tube 4 due to a failure of the weld 8. Such failures of the previously known point detector sleeves 2 have resulted in inaccurate indications of the positions of the movable tracks and have required repair of the switch machines in which such failed point detector sleeves 2 have been installed. It thus is desired to provide an improved point detector sleeve that substantially reduces or eliminates the potential for separation of the component having the beveled surface 13 formed thereon from the portion having the threaded nut surface 12.

It is also desired to provide such an improved point detector sleeve in an economical fashion. In this regard, it is understood that in drilling or otherwise cutting a cylindrical hole into a solid bar of material, the drill bit or other rotary cutting tool has a tendency to radially "walk" during the drilling process such that the resulting hole is far from being substantially cylindrical. As such, additional cutting steps such as spiral reaming and the like must be performed on the non-cylindrical hole to make the hole cylindrical. Still additional cutting steps must be performed to ensure that the cylindrical hole is oriented coaxially with a cylindrical outer surface of the block of material. As such, while it would be preferred for an improved point detector sleeve to be formed out of a single piece of material, any method by which such an improved point detector sleeve is manufactured would preferably overcome the shortcomings associated with the multiple process steps otherwise required to form a cylindrical hole that is coaxially oriented with a cylindrical outer surface of a piece of material.

SUMMARY OF THE INVENTION

In view of the foregoing, an improved point detector sleeve includes a tube portion and an adjustment portion that are integrally formed with one another as a monolithic member, whereby the point detector sleeve is substantially free of joints between the tube portion and the adjustment portion. The tube portion includes a beveled surface formed thereon, and the adjustment portion includes an internally threaded region formed thereon. In accordance with one method of manufacturing the improved point detector sleeve, a first end of a hollow cylindrical pipe formed with a cylindrical cavity is cut with a rotary cutting tool to form a substantially cylindrical inner surface. The rotary cutting tool advantageously closely follows the cavity to form the cylindrical inner surface without the rotary cutting tool radially "walking" away from a central longitudinal axis of the pipe. In the first embodiment, the pipe initially has a thicker wall than the wall of the previously known point detector sleeve. In a second embodiment, the pipe is a forged or cast member. In a third embodiment, the pipe has the same wall thickness as in the previously known point detector sleeve, but one end of the pipe is formed with an internally threaded region that receives therein an insert having an externally threaded region and an internally threaded surface.

Accordingly, an aspect of the present invention is to provide an improved point detector sleeve having a tube portion and an adjustment portion that are integrally formed with one another as a monolithic member.

Another aspect of the present invention is to provide an improved point detector sleeve having a tube portion and an adjustment portion and that is substantially free of joints between the tube portion and the adjustment portion.

Another aspect of the present invention is to provide a method of manufacturing an improved point detector sleeve that is substantially free of joints between a tube portion and an adjustment portion thereof in an economical fashion.

Another aspect of the present invention is to provide a method of manufacturing an improved point detector sleeve whereby a hollow substantially cylindrical pipe having a substantially cylindrical cavity is provided, and whereby during a cutting operation a rotary cutting tool closely follows the cavity to provide a substantially cylindrical inner surface.

Another aspect of the present invention is to provide an improved point detector sleeve that is substantially immune to breakage due to a failure of a weld.

Accordingly, and aspect of the present invention is to provide a point detector sleeve for use in a railroad switch machine, in which the general nature of the point detector sleeve can be stated as including a tube portion having a beveled surface disposed at an end thereof, the beveled surface being structured to engageable with a cam follower, an adjustment portion connected with the tube portion and disposed opposite the beveled surface, the tube portion and the adjustment portion being integrally formed with one another as a monolithic member, whereby the point detector sleeve is substantially free of joints between the tube portion and the adjustment portion, the adjustment portion including an internally threaded region, and at least a first tool engagement surface being disposed on the point detector sleeve.

Another aspect of the present invention is to provide a method of forming a point detector sleeve for use in a railroad switch machine, in which the general nature of the method can be generally stated as including the steps of providing an elongated pipe having a substantially cylindrical outer surface and being formed with a substantially cylindrical primary cavity, the primary cavity being coaxially aligned with the outer surface, performing a cutting operation on the primary cavity from a first end of the pipe with a rotary cutting tool to form a substantially cylindrical inner surface that is coaxially aligned with the outer surface and that defines a tube portion of the pipe, forming an internally threaded region on the pipe to define an adjustment portion of the pipe, the internally threaded region being coaxially aligned with the outer surface and being structured to cooperate threadably with a point detector bar, providing at least a first tool engagement surface on the pipe, and forming a beveled surface on the tube portion at the first end.

Another aspect of the present invention is to provide a method of forming a point detector sleeve for use in a railroad switch machine, in which the general nature of the method can be stated as including the steps of providing an elongated pipe having a substantially cylindrical outer surface and being formed with a substantially cylindrical primary cavity, the primary cavity being coaxially aligned with the outer surface, forming a beveled surface at a first end of the pipe, forming an internally threaded region at a second end of the pipe, the internally threaded region being coaxially aligned with the outer surface of the pipe, and providing at least a first tool engagement surface on the pipe.

Another aspect of the present invention is to provide a switch machine, the general nature of which can be stated as including a power apparatus, a locking apparatus, and a detection apparatus, the detection apparatus including a point detector sleeve, a point detector bar having an externally threaded region, a cam follower, and an indication system, the point detector sleeve including a tube portion, an adjustment portion, and at least a first tool engagement surface, the tube portion including a beveled surface disposed at an end of the tube portion, the beveled surface being engageable with the cam follower, the adjustment portion being connected with the tube portion and disposed opposite the beveled surface, the tube portion and the adjustment portion being integrally formed with one another as a monolithic member, whereby the point detector sleeve is substantially free of joints between the tube portion and the adjustment portion, the adjustment portion including an internally threaded region, and the least first tool engagement surface being disposed on the point detector sleeve.

BRIEF DESCRIPTION OF THE DRAWINGS

A further understanding of the invention can be gained from the following description of the preferred embodiments when read in conjunction with the accompanying drawings in which.

Similar numerals refer to similar parts throughout this specification.

DESCRIPTION OF THE PREFERRED EMBODIMENTS

Figure 1:
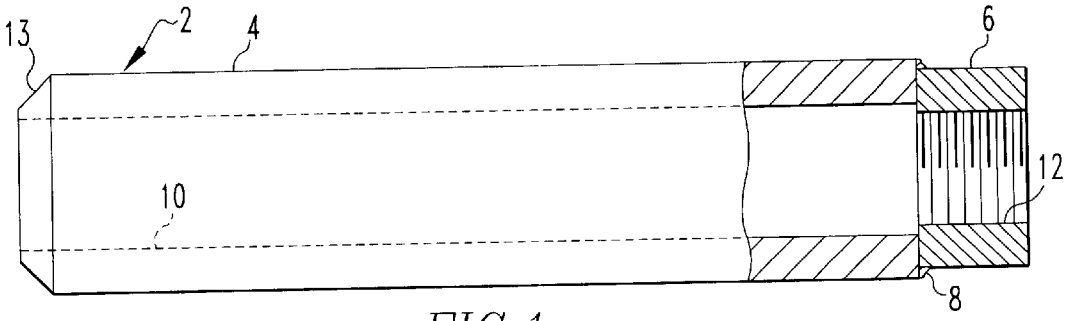
FIG.1 PRIOR ART
FIG. 1 is a side elevational view, partially cut away, of a previously known point detector sleeve.

A point detector sleeve 14 in accordance with a first embodiment of the present invention is indicated generally in FIGS. 2–7. The point detector sleeve 14 can be incorporated into a switch machine 16 (FIG. 7) in accordance with the present invention. The point detector sleeve 14 is advantageously configured to overcome problems with breakage that had been associated with previously known point detector sleeves.

As will be set forth more fully below, the point detector sleeve 14 is configured to include a tube portion 28 and an adjustment portion 30 that are integrally formed with one another as a monolithic member. As such, the point detector sleeve 14 is substantially free of joints between the tube portion 28 and the adjustment portion 30.

The point detector sleeve 14 is manufactured out of a pipe 18 having a substantially cylindrical outer surface 20 and having a first end 22 and a second end 24 opposite one another. The pipe 18 additionally includes a central longitudinal axis 26 that is coaxially oriented with respect to the outer surface 20. As will be set forth more fully below, a number of cutting or other forming steps transform the pipe 18 into the point detector sleeve 14.

Figure 2:
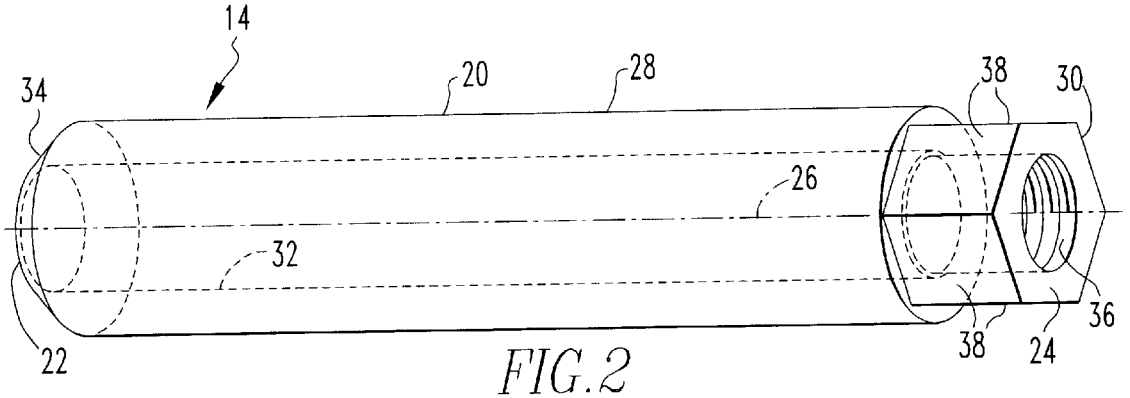
FIG. 2 is a perspective view of an improved point detector sleeve in accordance with a first embodiment of the present invention.

As can be seen in FIG. 2, the tube portion 28 includes a substantially cylindrical inner surface 32 that is substantially non-threaded as well as a substantially frusto-conic beveled surface 34 that is formed at the first end 22. The adjustment portion 30 includes an internally threaded region 36, and further includes a plurality of flats 38 formed on the outer surface 20 that serve as tool engagement surfaces. While the flats 38 depicted in FIG. 2 are configured in a hexagonal fashion, it is understood that any number of pairs of parallel and spaced flats 38 may be employed and would be cooperable with an appropriate wrench, spanner, or other such tool.

It is further understood that other types of tool engagement surfaces different than the flats 38 may be provided on the point detector sleeve 14. For instance, the point detector sleeve 14 may include a tool engagement surface that is knurled or that is splined, or that may even be smooth. Such a knurled, splined, or smooth surface can be engaged by tools such as pliers or other such tools, or can be engaged manually, with the fingers of the hand functioning as a tool.

It thus can be seen that the improved point detector sleeve 14 provides substantially all of the functional features of the previously known point detector sleeve 2, and includes the tube portion 28 and the adjustment portion 30 being integrally formed as a monolithic member substantially free of joints therebetween, as will be set forth more fully below.

Figure 3:
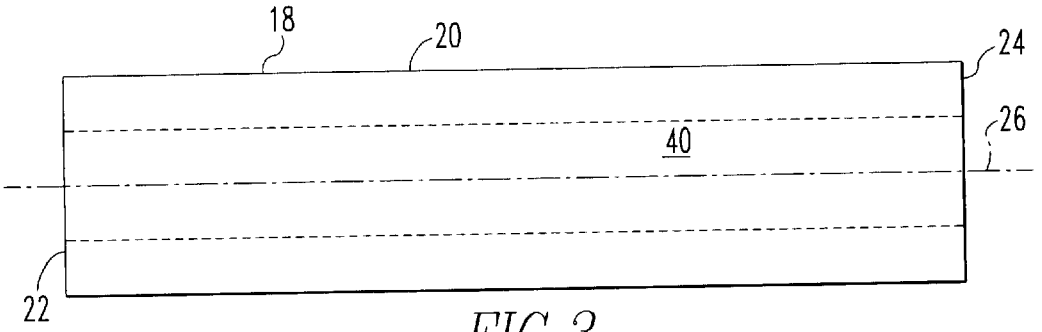
FIG. 3 is a side elevational view a pipe out of which the first embodiment of FIG. 2 can be manufactured.

As can be seen in FIG. 3, prior to forming the point detector sleeve 14 the pipe 18 is formed with a substantially cylindrical primary cavity 40 extending longitudinally therethrough and being coaxially aligned with the outer surface 20 and with the central longitudinal axis 26. The pipe has an initial wall thickness defined as the distance between the surface of the primary cavity 40 and the outer surface 20. The pipe 18 preferably is a section of commercially available tube stock having closely controlled dimensions and concentricity of the surfaces thereof.

Figure 4:
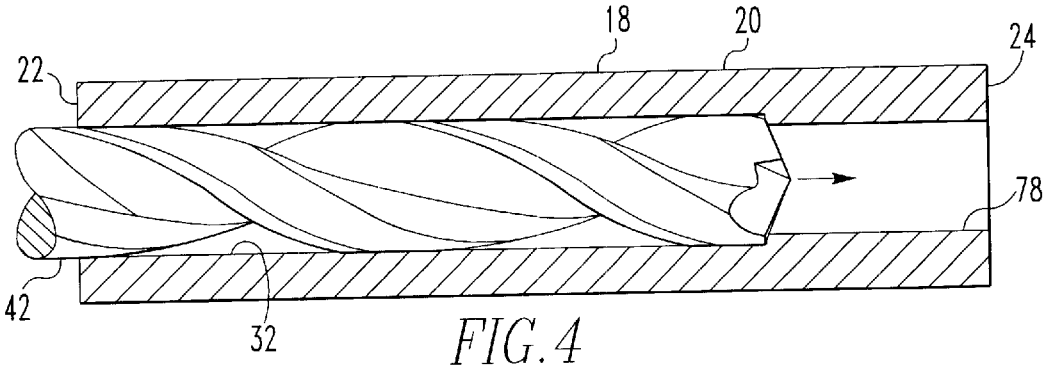
FIG. 4 is an operational view of a cutting operation being performed on the pipe of FIG. 3.

In order to form the inner surface 32, a cutting operation is performed on the primary cavity 40 from the first end 22 of the pipe 18 with a rotary cutting tool 42 (FIG. 4) which removes a small amount of the material of the pipe 18 and forms the inner surface 32 which is of a desired cross-sectional diameter. It thus can be seen that the tube portion 28 has a wall thickness less than that of the original pipe 18. The rotary cutting tool 42 is depicted in FIG. 4 as being a drill bit, and the cutting operation is depicted as being a drilling operation, it being understood that other similar cutting operations may be performed with different rotary cutting tools without departing from the concept of the present invention.

In accordance with the present invention, it can be seen that in performing the cutting operation whereby the rotary cutting tool 42 removes material from the primary cavity 40 of the pipe 18 to form the inner surface 32, the rotary cutting tool 42 advantageously follows the primary cavity 40 and thus does not meaningfully vary or "walk" in a radial direction from the central longitudinal axis 26. As such, by performing the cutting operation on the pipe 18 with the existing primary cavity 40, the inner surface 32 that results from the cutting operation is substantially cylindrical, true, and coaxially oriented with the central longitudinal axis 26. In this regard, the inner surface 32 is substantially more cylindrical and true than would otherwise be the case if the cutting operation were performed on a solid block of material that did not have the primary cavity 40 formed therein. As such, by providing the pipe 18 with the primary cavity 40 already formed therein, the inner surface 32 can be configured to have a substantially true and substantially cylindrical shape with a relatively simple cutting operation with the rotary cutting tool 42.

Figure 5:
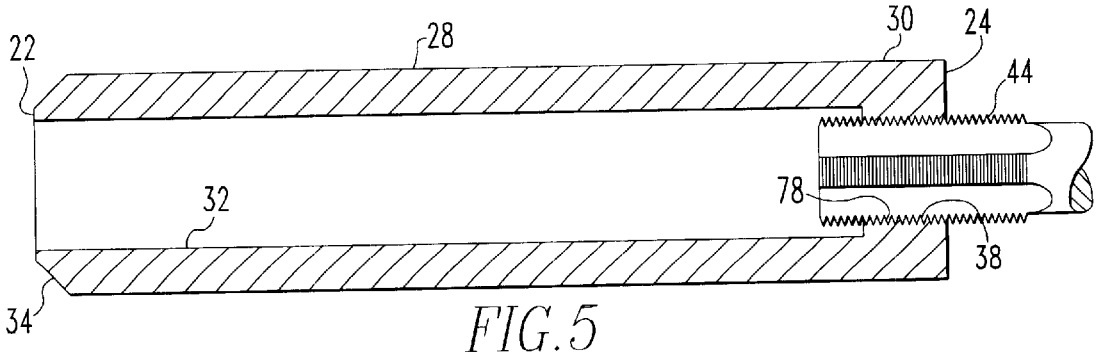
FIG. 5 is an operational view of a cutting operation being performed on the pipe of FIG. 3
Figure 6:
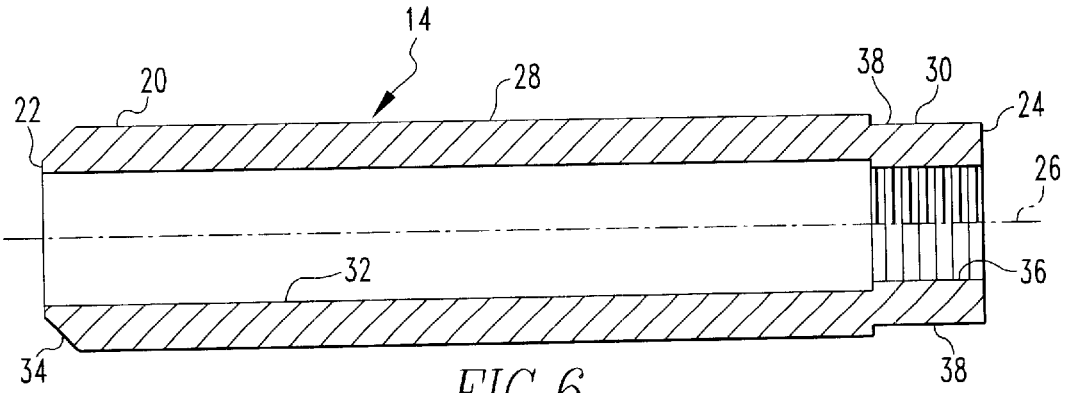
FIG. 6 is a side elevational view, partially cut away, of the first embodiment of FIG. 2.

In performing the aforementioned cutting operation, the rotary cutting tool 42 is advanced less than fully through the pipe 18 and is stopped prior to reaching the second end 24. As a result, a portion of the primary cavity 40 adjacent the second end 24 is not cut away, and such remaining portion will be referred to herein as a secondary cavity 78 (FIGS. 5 and 6.) It can be seen from FIGS. 5 and 6 that the cross-sectional diameter of the secondary cavity 78 is generally less than that of the inner surface 32.

A second cutting operation is performed on the secondary cavity 78 to form the internally threaded region 36. More specifically, a tap 44 is rotatingly advanced into the secondary cavity 78 from the second end 24 of the pipe 18, and the tap 44 threads the secondary cavity 78 to form the internally threaded region 36. It is understood that other known cutting tools may be employed to thread the secondary cavity 78 and to thereby form the internally threaded region 36.

In order to perform the aforementioned cutting operations, the pipe 18 is held at the outer surface 20 thereof by an appropriate chuck (not shown) or other tool. By holding the pipe 18 by the outer surface 20 during formation of both the inner surface 32 and the internally threaded region 36, it can be seen that the inner surface 32 and the internally threaded region 36 are axially aligned with one another and are both coaxially aligned with the outer surface 20 and with the central longitudinal axis 26.

While it is not specifically depicted in FIGS. 5 and 6, an additional cutting operation is performed at the first end 22 of the pipe 18 to form the beveled surface 34. Also not specifically shown is an additional cutting operation whereby the flats 38 are formed on the outer surface 20 with known cutting or forming machinery. While the flats 38 are depicted as being formed on the adjustment portion 30, it is understood that in other configurations the flats 38 may be spaced or otherwise separated from the internally threaded region 36 without departing from the concept of the present invention.

Figure 7:
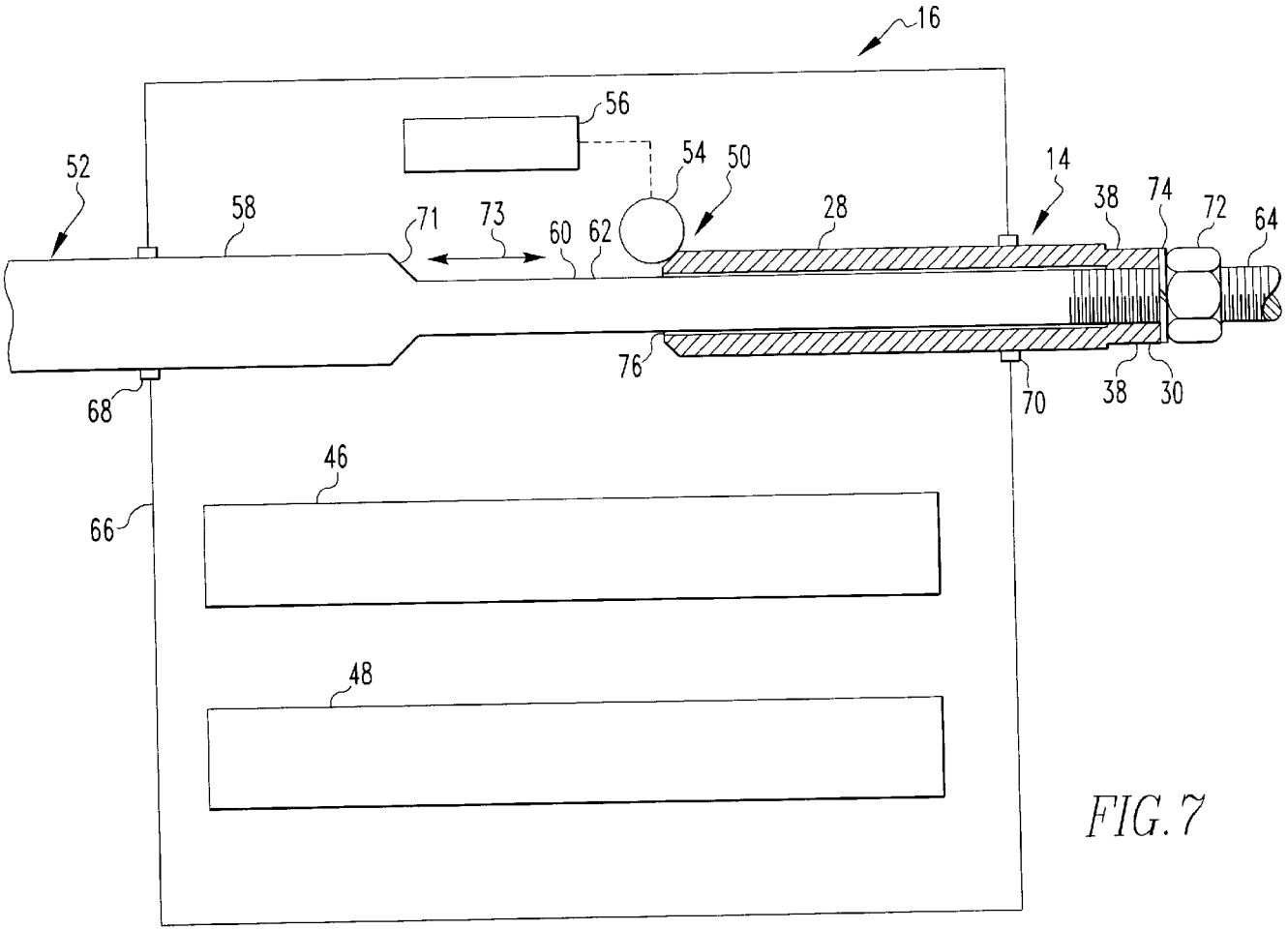
FIG. 7 is a schematic plan view of a switch machine in accordance with the present invention that incorporates the first embodiment of FIG. 2.

As indicated above, the point detector sleeve 14 can be advantageously employed in the switch machine 16. As can be seen in FIG. 7, the switch machine 16 includes a power apparatus 46, a locking apparatus 48, and a detection apparatus 50. The power apparatus 46 and the locking apparatus 48 are both schematically depicted in FIG. 7, it being understood that components of each extend outward from the switch machine 16 and are operatively connected with the movable tracks (not shown). The point detector sleeve 14 is incorporated into the detection apparatus 50 which is configured to detect the position of the movable tracks with respect to the first and second stock rails (not shown).

As can be seen in FIG. 7, in addition to the point detector sleeve 14 the detection apparatus 50 includes a point detector bar 52 that extends outwardly from the switch machine 16 and is operatively connected with the movable tracks (not shown), a cam follower 54 that is movably mounted on the switch machine 16, and an indication system 56 that is configured to provide some type of indication such as a light or other signal that indicates the position of the movable tracks with respect to the first and second stock rails. It can be seen that the indication system 56 is operatively connected with the cam follower 54, and it is understood that the position of the cam follower 54 determines the existence and the nature of the indication that is provided by the indication system 56. It is further understood that the cam follower depicted in FIG. 7 is provided to be engageable with the point detector sleeve 14, and that a separate cam follower (not shown) that would be operatively connected with the indication system 56 would be provided to be engageable with the point detector bar 52.

The switch machine 16 also includes a housing 66 upon which are mounted a pair of bushings 68 and 70. The point detector bar 52 includes a connector bar 58 and a shank 60. The connector bar 58 extends through the bushing 68 and is operatively connected with the movable tracks (not shown). The shank 60 includes a non-threaded portion 62 and an externally threaded region 64. The point detector sleeve 14 is adjustably mounted on the shank 60 and extends through the bushing 70. More specifically, the internally threaded region 36 of the adjustment portion 30 of the point detector sleeve 14 is threadably cooperable with the externally threaded region 64 of the shank 60.

It can also be seen that the point detector bar 52 includes a substantially frusto-conic beveled surface 71 extending between the connector bar 58 and the shank 60. Both the beveled surfaces 34 and 71 are typically spaced from the cam followers 54 but are engageable with the cam followers 54 if vibrations resulting from the passage of a train cause the point detector bar 52 to translate. Engagement of the cam followers 54 with the beveled surfaces 34 and 71 causes the cam followers 54 to be pushed gradually radially away from the point detector bar 52 and thereby cause minimal damage to the cam followers 54.

It can be seen that the point detector bar 52 and the point detector sleeve 14 mounted thereon are translatable along a direction defined generally by the arrow 73. Depending upon the specific position of the movable tracks with respect to the stock rails, one of the beveled surfaces 34 and 71 may be engageable with the cam follower 54 to cause the indication system to provide a signal that the switch is not safe for a train to pass. The point detector sleeve 14 is advantageously adjustable on the externally threaded region 64 to permit the position of the beveled surface 34 to be adjusted with respect to the beveled surface 71 and to the point detector bar 52 in general.

Once the point detector sleeve 14 has been rotatably adjusted to a desirable position with respect to the point detector bar 52 by the use of an appropriate tool such as a wrench applied to the flats 38, the point detector sleeve 14 is fixed in the aforementioned position by application of a jam nut 72 and a lock washer 74. More specifically, the lock washer 74 is interposed between the jam nut 72 and the point detector sleeve 14, and the jam nut 72 is then tightened against the point detector sleeve 14 which results in residual forces therebetween. Such residual forces retain the point detector sleeve 14 in the desired position with respect to the point detector bar 52.

It can be seen from FIG. 7 that with the point detector sleeve 14 installed on the point detector bar 52 as such, a small clearance 76 exists between the non-threaded portion 62 of the shank 60 and the inner surface 32 of the tube portion 28. Such a clearance 76 is provided to permit the externally threaded regions 64 of the shank 60 to be received therethrough and to be threadably cooperated with the internally threaded region 36. With the jam nut 72 and the lock washer 74 securely engaged with the point detector sleeve 14 as set forth above, the clearance 76 is of a generally annular shape and is retained in such shape by the aforementioned residual forces to ensure appropriate engagement of the beveled surface 34 with the cam follower 54 under circumstances that are calculated to cause the indication system to send an appropriate signal.

As the point detector bar 52 and the point detector sleeve 14 translate along the direction defined by the arrow 73, the point detector sleeve 14 remains securely mounted on the shank 60, and the tube portion 28 advantageously is substantially immune from separation from the adjustment portion 30 inasmuch as the tube portion 28 and the adjustment portion 30 are advantageously integrally formed with one another as a monolithic member and are substantially free of joints therebetween. As such, a mode of failure to which previously point detector sleeves had been subject has been overcome by the improved point detector sleeve 14 of the present invention.

Figure 8:
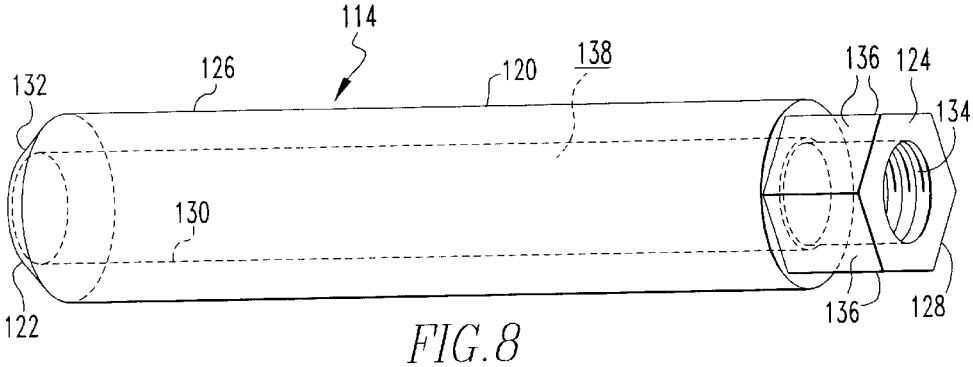
FIG. 8 is a side perspective view of an improved point detector sleeve in accordance with a second embodiment of the present invention.
Figure 9:
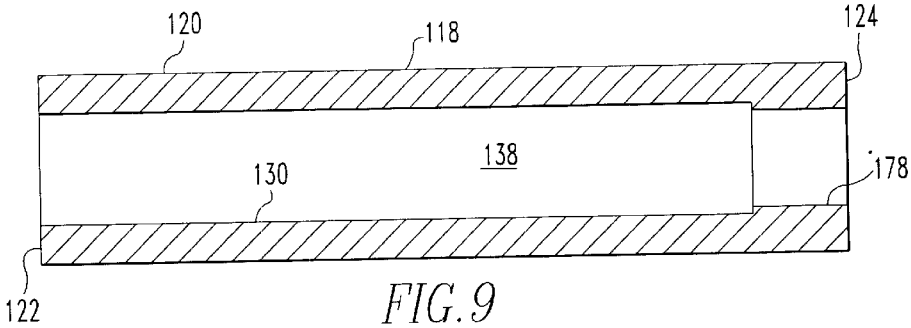
FIG. 9 is a cross-sectional side elevational view of a pipe out of which the second embodiment of FIG. 8 can be manufactured.

A second embodiment of a point detector sleeve 114 in accordance with the present invention is indicated generally in FIGS. 8 and 9. More specifically, FIG. 9 depicts a pipe 118 out of which the point detector sleeve 114 is manufactured. It can be seen that the pipe 118 includes a substantially cylindrical outer surface and includes a first end 122 and a second end 124 opposite one another. The point detector sleeve 114 includes a tube portion 128 and an adjustment portion 130 that are integrally formed with one another as a monolithic member and thus are substantially free of joints therebetween. The pipe 118 is formed by processes such as forging, casting, and the like, to include a substantially cylindrical primary cavity 140 and a substantially cylindrical secondary cavity 178 that are axially aligned with one another and are both coaxially aligned with the outer surface 120. The pipe 118 is advantageously configured, however, to not require a cutting operation to be performed on the primary cavity 140. Rather, the primary cavity 140 is configured to provide an inner surface 132 that is substantially non-threaded and that is of an appropriate cross-sectional diameter for use on the point detector bar 52 of the switch machine 16. Cutting or other forming operations such as those set forth above are, however, used to form the beveled surface 134, the internally threaded region 136, and the flats 138 that serve as tool engagement surfaces.

It thus can be seen that by specifically configuring the pipe 118 to have a primary cavity 140 having a cross-sectional diameter that does not require a cutting operation to provide the inner surface 132, the point detector sleeve 114 can potentially be manufactured less expensively than the point detector sleeve 14, depending upon the costs associated with special formation of the pipe 118. It is understood, however, that the pipe 118 can nevertheless be configured to require such a cutting operation to form the inner surface 132 without departing from the concept of the present invention.

Figure 10:
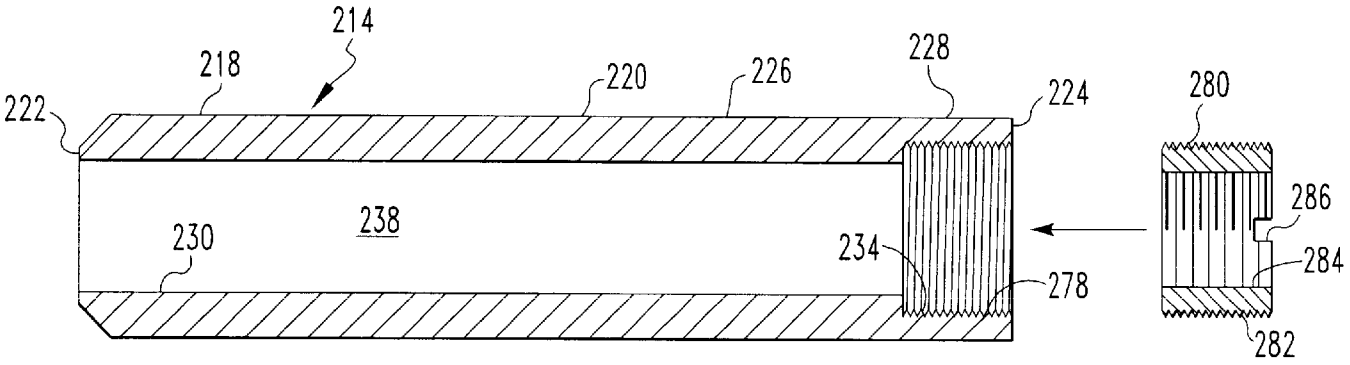
FIG. 10 is an exploded cross-sectional side elevational view of an improved point detector sleeve in accordance with a third embodiment of the present invention.
Figure 11:
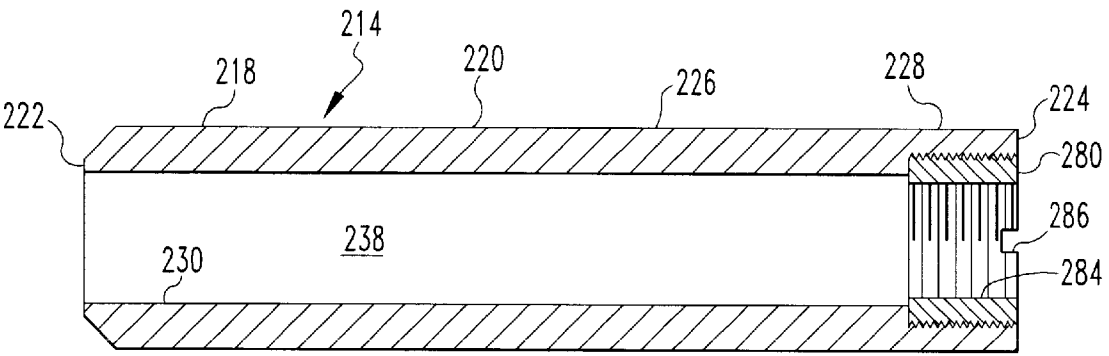
FIG. 11 is an assembled cross-sectional side elevational view of the third embodiment of FIG. 10.

A third embodiment of a point detector sleeve 214 in accordance with the present invention is indicated generally in FIGS. 10 and 11. The point detector sleeve 214 is formed from a section of pipe 218 having an outer surface 220, including a first end 222 and a second end 224 opposite one another, and being formed with a primary cavity 240 that defines a substantially non-threaded inner surface 232. The pipe 218 is preferably a generally available section of pipe stock that is configured such that the primary cavity 240 provides the inner surface 232 that is of a desired cross-sectional diameter without requiring a cutting operation to form the inner surface 232.

A cutting operation is, however, performed on the pipe 218 to provide a secondary cavity 278 at the second end 224. More specifically, the secondary cavity 278 is threaded to provide an internally threaded region 236 having a cross-sectional diameter greater than that of the cross-sectional diameter of the inner surface 232. In this regard, it can be seen that the pipe 218 provides the point detector sleeve 214 with a tube portion 228 and an adjustment portion 230 that are integrally formed with one another as a monolithic member and are substantially free of joints therebetween.

After the internally threaded region 236 is formed on the second cavity 278, an annular insert 280 is threadably received in the internally threaded region 236. The insert 280 includes a substantially cylindrical externally threaded surface 282 and a substantially cylindrical internally threaded surface 284 that are coaxially oriented with one another. The insert 280 additionally includes a pair of notches 286 (only one of which is depicted in FIGS. 10 and 11) that serve as tool engagement surfaces for rotating the insert 280 with respect to the pipe 218.

It can be seen that the externally threaded surface 282 of the insert 280 cooperates threadably with the internally threaded region 236 of the adjustment portion 230. It can further be seen that the internally threaded surface 284 is threadably cooperable with the externally threaded region 64 of the point detector bar 52. In this regard, it can be seen that the cross-sectional diameter of the internally threaded surface 284 is less than the cross-sectional diameter of the inner surface 232.

When the insert 280 is received in the adjustment portion 230 as set forth above, the insert 280 is preferably fixed in place by tightening and optionally the addition of a thread locking compound or mechanical fixing structures such as rivets, flattening of the second end 224, and the like. It thus can be seen that the tube portion 228 and the adjustment portion 230 are integrally formed with one another as a monolithic member and are substantially free of joints therebetween. The adjustment portion 230 additionally receives the insert 280 therein, whereby a threaded joint exists between the insert 280 and the adjustment portion 230. Such a threaded joint is far more mechanically reliable, easier to inspect, and more predictable in operation than a weld. As such, by providing the tube portion 228 and the adjustment portion 230 as an integrally formed monolithic member substantially free of joints therebetween, and by providing the insert 280 with a threaded joint between it and the adjustment portion 230, substantial shortcomings to which previously known point detector sleeves have been subject have been successfully overcome.

The point detector sleeves 14, 114, and 214 can be interchangeably used with the point detector bar 52 of the switch machine 16. The point detector sleeves 14, 114, and 214 are advantageously configured to overcome the problem of breakage to which previously known point detector sleeves have been subject. The point detector sleeves 14, 114, and 214, as well as the associated methods of forming the same, thus provide new benefits previously unknown in the relevant art.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A point detector sleeve for use in a railroad switch machine, the point detector sleeve comprising:

a tube portion including a beveled surface disposed at an end thereof, the beveled surface being structured to be engageable with a cam follower;

an adjustment portion connected with the tube portion and disposed opposite the beveled surface;

the tube portion and the adjustment portion being integrally formed with one another as a monolithic member, whereby the point detector sleeve is substantially free of joints between the tube portion and the adjustment portion;

the adjustment portion including an internally threaded region; and at least a first tool engagement surface being disposed on the point detector sleeve.

2. The point detector sleeve as set forth in claim 1, in which the at least first tool engagement surface is disposed on the adjustment portion.

3. A point detector sleeve for use in a railroad switch machine, the point detector sleeve comprising:

a tube portion including a beveled surface disposed at an end thereof, the beveled surface being structured to be engageable with a cam follower;

an adjustment portion connected with the tube portion and disposed opposite the beveled surface;

the tube portion and the adjustment portion being integrally formed with one another as a monolithic member, whereby the point detector sleeve is substantially free of joints between the tube portion and the adjustment portion;

the adjustment portion including an internally threaded region; and at least a first tool engagement surface being disposed on the point detector sleeve;

in which the at least first tool engagement surface includes a pair of spaced apart flats.

4. A point detector sleeve for use in a railroad switch machine, the point detector sleeve comprising:

a tube portion including a beveled surface disposed at an end thereof, the beveled surface being structured to be engageable with a cam follower;

an adjustment portion connected with the tube portion and disposed opposite the beveled surface;

the tube portion and the adjustment portion being integrally formed with one another as a monolithic member, whereby the point detector sleeve is substantially free of joints between the tube portion and the adjustment portion;

the adjustment portion including an internally threaded region; and at least a first tool engagement surface being disposed on the point detector sleeve;

in which the adjustment portion further includes an insert having an externally threaded surface and an internally threaded surface, the externally threaded surface of the insert being threadably cooperable with the internally threaded region, of the adjustment portion, the internally threaded surface of the insert being structured to cooperate threadably with a point detector bar.

5. The point detector sleeve as set forth in claim 4, in which the insert is disposed substantially internally within the adjustment portion.

6. The point detector sleeve as set forth in claim 4, in which the insert includes at least a first tool engagement surface.

7. The point detector sleeve as set forth in claim 6, in which the at least first tool engagement surface is a notch formed on the insert.

8. A method of forming a point detector sleeve for use in a railroad switch machine, the method comprising the steps of:

providing an elongated pipe having a substantially cylindrical outer surface and being formed with a substantially cylindrical primary cavity, the primary cavity being coaxially aligned with the outer surface;

performing a cutting operation on the primary cavity from a first end of the pipe with a rotary cutting tool to form a substantially cylindrical inner surface that is coaxially aligned with the outer surface and that defines a tube portion of the pipe;

forming an internally threaded region on the pipe to define an adjustment portion of the pipe, the internally threaded region being coaxially aligned with the outer surface and being structured to cooperate threadably with a point detector bar;

providing at least a first tool engagement surface on the pipe; and forming a beveled surface on the tube portion at the first end.

9. The method as set forth in claim 8, in which the step of performing a cutting operation includes the step of using the primary cavity as a cutting guide by following the primary cavity with the rotary cutting tool.

10. The method as set forth in claim 9, in which the step of using the primary cavity as a cutting guide includes the step of resisting radial movement of the rotary cutting tool away from a central longitudinal axis of the pipe.

11. The method as set forth in claim 8, in which the step of forming an internally threaded region includes the step of forming the internally threaded region at a second end of the pipe.

12. The method as set forth in claim 8, in which the step of providing an elongated pipe includes the step of providing the pipe with a substantially cylindrical secondary cavity having a cross sectional diameter smaller than a cross sectional diameter of the primary cavity.

13. The method as set forth in claim 12, in which the step of forming an internally threaded region on the pipe includes the step of forming the internally threaded region on the secondary cavity.

14. A method of forming a point detector sleeve for use in a railroad switch machine, the method comprising:

providing an elongated pipe having a substantially cylindrical outer surface and being formed with a substantially cylindrical primary cavity, the primary cavity being coaxially aligned with the outer surface;

performing a cutting operation on the primary cavity from a first end of the pipe with a rotary cutting tool to form a substantially cylindrical inner surface that is coaxially aligned with the outer surface and that defines a tube portion of the pipe;

forming an internally threaded region on the pipe to define an adjustment portion of the pipe, the internally threaded region being coaxially aligned with the outer surface and being structured to cooperate threadably with a point detector bar;

providing at least a first tool engagement surface on the pipe; and forming a beveled surface on the tube portion at the first end;

in which the step of providing at least a first tool engagement surface on the pipe includes the step of forming a pair of spaced apart flats on the adjustment portion.

15. A method of forming a point detector sleeve for use in a railroad switch machine, the method comprising the steps of:

providing an elongated pipe having a substantially cylindrical outer surface and being formed with a substantially cylindrical primary cavity, the primary cavity being coaxially aligned with the outer surface;

forming a beveled surface at a first end of the pipe;

forming an internally threaded region at a second end of the pipe, the internally threaded region being coaxially aligned with the outer surface of the pipe; and providing at least a first tool engagement surface on the pipe.

16. The method as set forth in claim 15, in which the step of forming an internally threaded region at a second end of the pipe includes the steps of receiving an insert having an externally threaded surface and an internally threaded surface into the second end and threadably cooperating the external threaded surface of the insert with the internally threaded region of the pipe.

17. The method as set forth in claim 16, further comprising the step of forming a secondary cavity at the second end of the pipe.

18. A method of forming a point detector sleeve for use in a railroad switch machine, the method comprising:

providing an elongated pipe having a substantially cylindrical outer surface and being formed with a substantially cylindrical primary cavity, the primary cavity being coaxially aligned with the outer surface;

forming a beveled surface at a first end of the pipe;

forming an internally threaded region at a second end of the pipe, the internally threaded region being coaxially aligned with the outer surface of the pipe; and providing at least a first tool engagement surface on the pipe;

in which the step of providing at least a first tool engagement surface on the pipe includes the step of forming a pair of spaced apart flats on the outer surface.

19. A switch machine comprising:

a power apparatus;

a locking apparatus; and a detection apparatus;

the detection apparatus including a point detector sleeve, a point detector bar having an externally threaded region, a cam follower, and an indication system;

the point detector sleeve including a tube portion, an adjustment portion, and at least a first tool engagement surface;

the tube portion including a beveled surface disposed at an end of the tube portion, the beveled surface being engageable with the cam follower;

the adjustment portion being connected with the tube portion and disposed opposite the beveled surface;

the tube portion and the adjustment portion being integrally formed with one another as a monolithic member, whereby the point detector sleeve is substantially free of joints between the tube portion and the adjustment portion;

the adjustment portion including an internally threaded region; and the least first tool engagement surface being disposed on the point detector sleeve.

20. The switch machine as set forth in claim 19, in which the internally threaded region of the point detector sleeve is threadably cooperable with the externally threaded region of the point detector bar.

21. A switch machine comprising:

a power apparatus;

a locking apparatus; and a detection apparatus;

the detection apparatus including a point detector sleeve, a point detector bar having an externally threaded region, a cam follower, and an indication system;

the point detector sleeve including a tube portion, an adjustment portion, and at least a first tool engagement surface;

the tube portion including a beveled surface disposed at an end of the tube portion, the beveled surface being engageable with the cam follower;

the adjustment portion being connected with the tube portion and disposed opposite the beveled surface;

the tube portion and the adjustment portion being integrally formed with one another as a monolithic member, whereby the point detector sleeve is substantially free of joints between the tube portion and the adjustment portion;

the adjustment portion including an internally threaded region; and the least first tool engagement surface being disposed on the point detector sleeve;

in which the adjustment portion further includes an insert having an externally threaded surface and an internally threaded surface, the externally threaded surface of the insert being threadably cooperable with the internally threaded region of the adjustment portion, the internally threaded surface of the insert being structured to cooperate threadably with a point detector bar.

22. The switch machine as set forth in claim 19, in which the detection apparatus further includes a locking member threadably mounted on the externally threaded region of point detector bar and engaged with the point detector sleeve.

* * * * *

UNITED STATES PATENT AND TRADEMARK OFFICE

CERTIFICATE OF CORRECTION

PATENT NO. : 6,474,605 B1
DATED : November 5, 2002
INVENTOR(S) : Leonard M. Wydotis et al.

It is certified that error appears in the above-identified patent and that said Letters Patent is hereby corrected as shown below:

Column 3,
Line 61, insert -- be -- prior to "engageable".

Column 11,
Line 34, remove the "," after "region".

Signed and Sealed this

Fourth Day of March, 2003

JAMES E. ROGAN
*Director of the United States Patent and Trademark Office*